US007398746B2

(12) United States Patent
Ohzono

(10) Patent No.: US 7,398,746 B2
(45) Date of Patent: Jul. 15, 2008

(54) VEHICLE

(75) Inventor: Gen Ohzono, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 164 days.

(21) Appl. No.: 11/283,021

(22) Filed: Nov. 18, 2005

(65) Prior Publication Data

US 2006/0112910 A1 Jun. 1, 2006

(30) Foreign Application Priority Data

Nov. 26, 2004 (JP) ..... 2004-343202

(51) Int. Cl.
*F01P 3/22* (2006.01)

(52) U.S. Cl. ..... 123/41.54; 165/51

(58) Field of Classification Search ..... 123/41.54, 123/41.51, 41.27; 165/104.32, 41, 917, 51; 180/229

See application file for complete search history.

(56) References Cited

U.S. PATENT DOCUMENTS 1,346,331 A * 7/1920 Muir ..... 123/41.1
1,710,268 A * 4/1929 Muir ..... 123/41.27
1,852,770 A * 4/1932 Duesenberg ..... 123/41.02
2,672,853 A * 3/1954 Dunnigan ..... 123/41.08
2,878,794 A * 3/1959 Stromberg ..... 123/41.27
3,265,048 A * 8/1966 Herbon ..... 123/41.14
3,741,172 A * 6/1973 Andreux ..... 123/41.27
4,006,775 A * 2/1977 Avrea ..... 165/51
4,367,699 A * 1/1983 Evans ..... 123/41.23
4,387,671 A * 6/1983 Jarvis ..... 123/41.27
4,640,235 A * 2/1987 Martin ..... 123/41.03
4,739,824 A * 4/1988 Howcroft ..... 165/104.32
4,753,289 A * 6/1988 Avrea ..... 165/104.32
5,755,189 A * 5/1998 Godeau et al. ..... 123/41.01
5,836,281 A * 11/1998 Godeau et al. ..... 123/195 A
6,125,646 A * 10/2000 Ebner ..... 62/298

FOREIGN PATENT DOCUMENTS

JP 10-212953 8/1998

* cited by examiner

*Primary Examiner*—Stephen K. Cronin
*Assistant Examiner*—Hyder Ali
(74) *Attorney, Agent, or Firm*—Keating & Bennett, LLP

(57) ABSTRACT

A vehicle is capable of simplifying attaching a connection member and an atmospheric discharge member to a reservoir tank of a vehicle body. The vehicle is arranged such that it includes a connection member for connecting a heat exchanger for cooling an engine and a reservoir tank for storing liquid therein. An atmospheric discharge member attached to the reservoir tank and having an atmospheric discharge opening is located in the vicinity of the connection member.

13 Claims, 10 Drawing Sheets

(A)

(B)

VEHICLE

BACKGROUND OF THE INVENTION

1. Field of the Invention

This invention relates to vehicles and particularly to a vehicle provided with a heat exchanger for cooling an engine and a reservoir tank for storing liquid therein.

2. Description of the Related Art

In a conventional motorcycle, there are provided a radiator for cooling an engine and a reservoir tank for keeping the amount of cooling water in the radiator constant. The reservoir tank is connected with an inlet hose to be connected to the radiator and a breather hose for atmospheric discharge, respectively. See JP-A-Hei 10-212953.

However, since the connecting region of the inlet hose to the reservoir tank and that of the breather hose to the reservoir tank are separate and spaced away from each other, it is difficult to fix these two hoses to the vehicle body with a single fixing member. Therefore, the two hoses are fixed to the vehicle body with independent, separate fixing members which raises a problem of troublesome work of fixing the hoses to the vehicle body as well as an increased number of parts.

SUMMARY OF THE INVENTION

In order to overcome the problems described above, preferred embodiments of the present invention provide a vehicle capable of simplifying the fixing of a connection member and an atmospheric discharge member to a reservoir tank of a vehicle body.

A vehicle according to a first preferred embodiment of the present invention includes a connection member for connecting a heat exchanger for cooling an engine and a reservoir tank for storing liquid therein, and an atmospheric discharge member attached to the reservoir tank and having an opening for atmospheric discharge located in the vicinity of the connection member.

A vehicle according to a second preferred embodiment of the present invention includes a reservoir tank for storing liquid therein, an atmospheric discharge member attached to the reservoir tank and provided with an opening for atmospheric discharge, and a mounting member integral with or separate from the reservoir tank for the attachment of the reservoir tank to a vehicle body and for the positioning of the atmospheric discharge member.

In the vehicle according to the first preferred embodiment of the present invention, since an opening of an atmospheric discharge member is located in the vicinity of a connection member, the atmospheric discharge member and the connection member can be fixed to the vehicle body with one (single) fixing member. As a result, fixing of the atmospheric discharge member and the connection member to the vehicle body can be simplified.

In the vehicle according to the second preferred embodiment of the present invention, since a mounting member is adapted to attach the reservoir tank to the vehicle body and to position the atmospheric discharge member, the atmospheric discharge member can be positioned using the mounting member. Thus, the positioning of the atmospheric discharge member can be facilitated. In addition, a special positioning member for positioning the atmospheric discharge member is dispensed with, thereby reducing the number of parts. If the mounting member is integral with the reservoir tank, the number of parts can be further reduced thereby improving assembly properties of the vehicle body.

Other features, elements, characteristics, and advantages will be apparent from the following detailed description of preferred embodiments with reference to the attached drawings.

DETAILED DESCRIPTION OF PREFERRED EMBODIMENTS

Now, description will be made of a vehicle according to a preferred embodiment of the present invention with reference to the drawings.

In this preferred embodiment, an example will be described in which the present invention is applied to an under-bone type motorcycle. It is to be understood that the present invention is not limited to an under-bone type motorcycle, but may be applied to vehicles in general.

Figure 1:
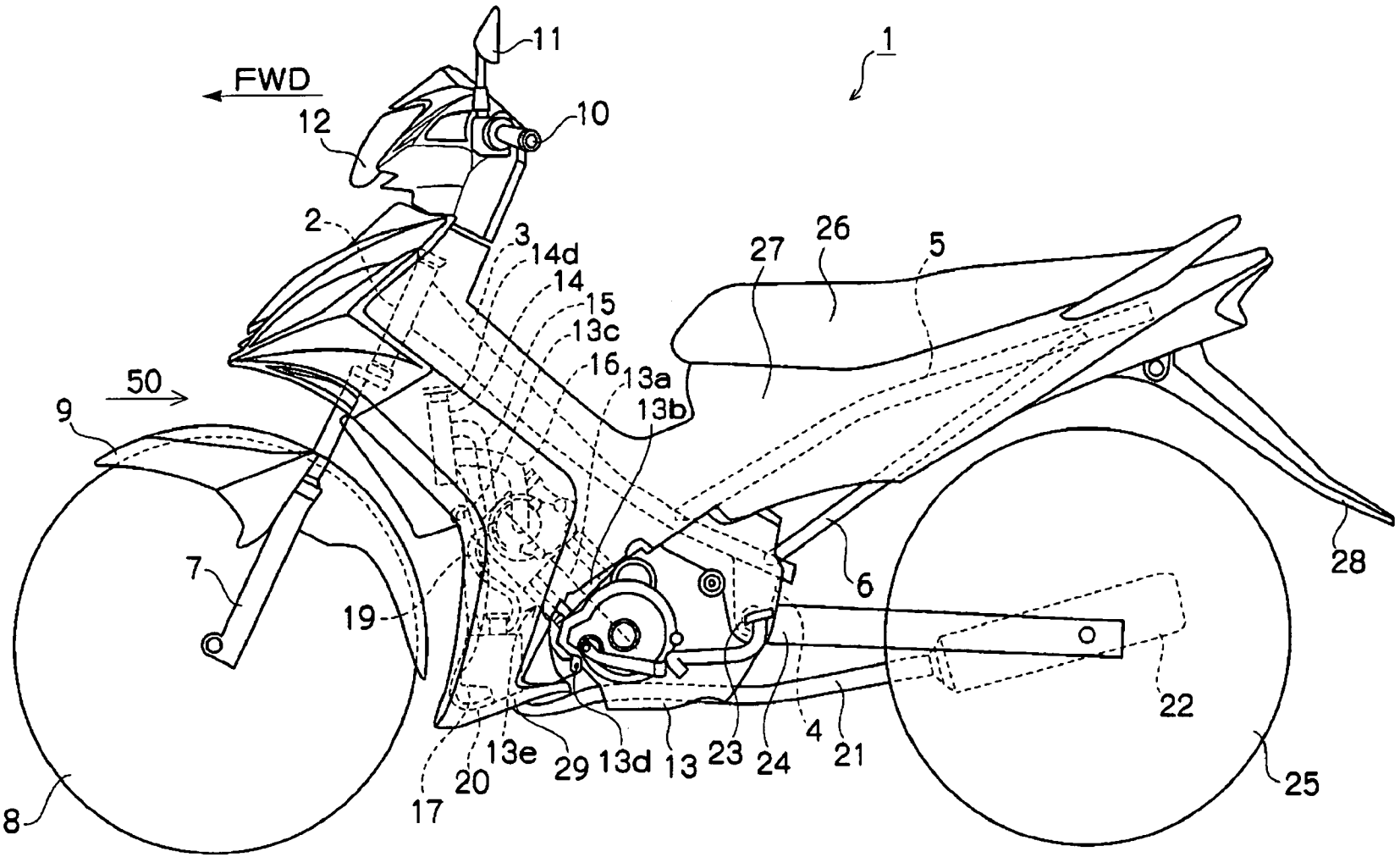
FIG. 1 is a side view showing the overall structure of a motorcycle according to a preferred embodiment of the present invention.
Figure 2:
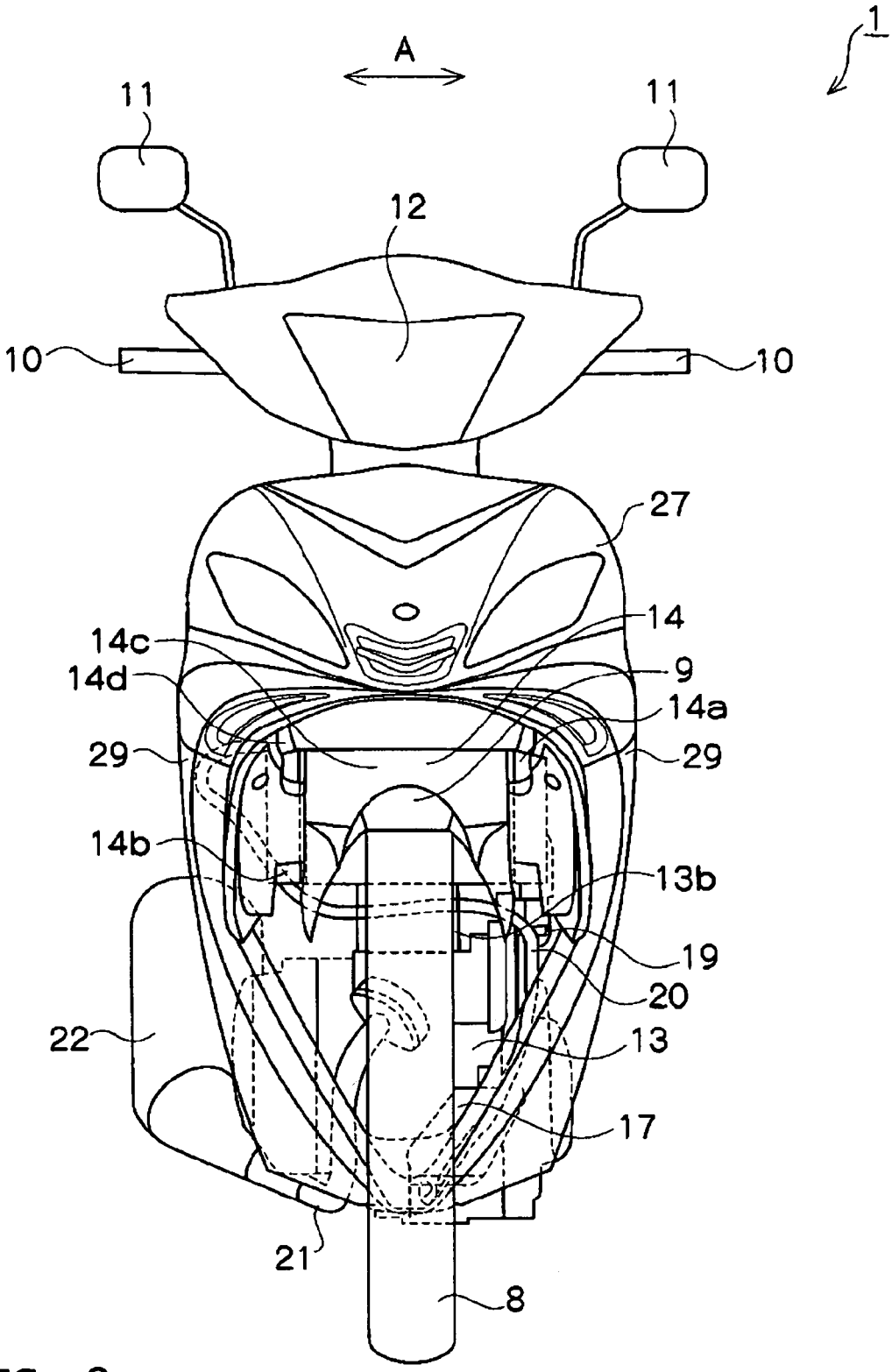
FIG. 2 is a front view of the motorcycle according to the preferred embodiment shown in FIG. 1.

As shown in FIG. 1 and FIG. 2, in an under-bone type motorcycle 1, the forward end of a main frame 3 is connected to a head pipe 2. The main frame 3 extends downwardly toward the rear. A rear arm bracket 4 is connected to the rear end of the main frame 3. Also, to the main frame 3 is connected a seat rail 5 extending upwardly toward the rear. A back stay 6 is connected between the rear end of the main frame 3 and the rear portion of the seat rail 5. The head pipe 2, main frame 3, rear arm bracket 4, seat rail 5, and back stay 6 make up a body frame.

Below the head pipe 2 is disposed a pair of front forks 7. A front wheel 8 is mounted for rotation to the lower ends of the pair of front forks 7. A front fender 9 for covering the front wheel 8 thereabove is disposed above the front wheel 8. Also, a handlebar 10 is attached above the head pipe 2 for rotation.

A rear view mirror 11 is mounted inside the handlebar 10. A head light 12 is disposed in front of and inside the handlebar 10.

An engine 13 is provided below the main frame 3, including a cylinder 13*b* with a cylinder axis 13*a* inclined obliquely upwardly toward the front at a given angle. The engine 13 has a mounting section 13*c* provided on the cylinder 13*b* and a mounting section 13*d* provided further downward from the cylinder 13*b* of the engine 13.

A radiator 14 is provided for cooling the engine 13, the radiator 14 being arranged in front of and above the engine 13 and below the main frame 3. The lower end of the radiator 14 is located above the lower surface 13*e* of the cylinder 13*b* of the engine 13. The radiator 14 is one example of the "heat exchanger" of the present invention. As shown in FIG. 2, the radiator 14 includes a pair of tank sections 14*a*, 14*b* spaced at a given distance in the lateral direction of the motorcycle 1 (in the direction of arrow A of FIG. 2) and a core section 14*c* disposed between the pair of tank sections 14*a*, 14*b*. The core section 14*c* includes numerous holes for the passage of a running wind 50 (see FIG. 1). A cap section 14*d* is attached to one tank section 14*b* with a non-illustrated pressure regulating valve. The radiator 14 is connected to the engine 13 by a feed pipe 15 and a return pipe 16.

When cooling the engine 13 by the radiator 14, cooling water warmed up by cooling the engine 13 is first sent to the tank section 14*a* of the radiator 14 through the feed pipe 15. The warmed cooling water is cooled by the core section 14*c* of the radiator 14 and thereafter sent to the tank section 14*b* of the radiator 14. The cooling water, which has been cooled down in the core section 14*c*, is returned to the engine 13 through the return pipe 16. In the core section 14*c* of the radiator 14, a running wind (air) 50 is adapted to hit against the core section 14*c* from the front, pass therethrough, and cool (via radiation) the cooling water.

A reservoir tank 17 is disposed below the lower surface 13*e* of the cylinder 13*b* of the engine 13 and on the right side of the body center line when viewed from the front of the vehicle body. The reservoir tank 17 stores as much cooling water as the increased volume of the cooling water due to the elevated water temperature in the radiator 14. Also, the radiator 14 draws by negative pressure as much cooling water as the decreased volume of the cooling water from the reservoir tank 17 due to the lowered temperature in the radiator 14, for the filling of the radiator 14. As such, the reservoir tank 17 has the function of keeping the amount of cooling water in the radiator 14 constant. Also, the reservoir tank 17 is preferably made from a semitransparent material allowing visual recognition from the outside of the amount of cooling water stored therein.

The reservoir tank 17 is connected to the radiator 14 by a feed and drainage pipe 20. Specifically, one end of the feed and drainage pipe 20 is connected to a first connection section 17*f* (see FIG. 5 and FIG. 6) located at the lower end of the reservoir tank 17 disposed on the right side of the body center line when viewed from the front of the vehicle body. The other end of the feed and drainage pipe 20 is connected to the cap section 14*d* of the radiator 14 disposed on the left side of the body center line when viewed from the front of the vehicle body.

Figure 5:
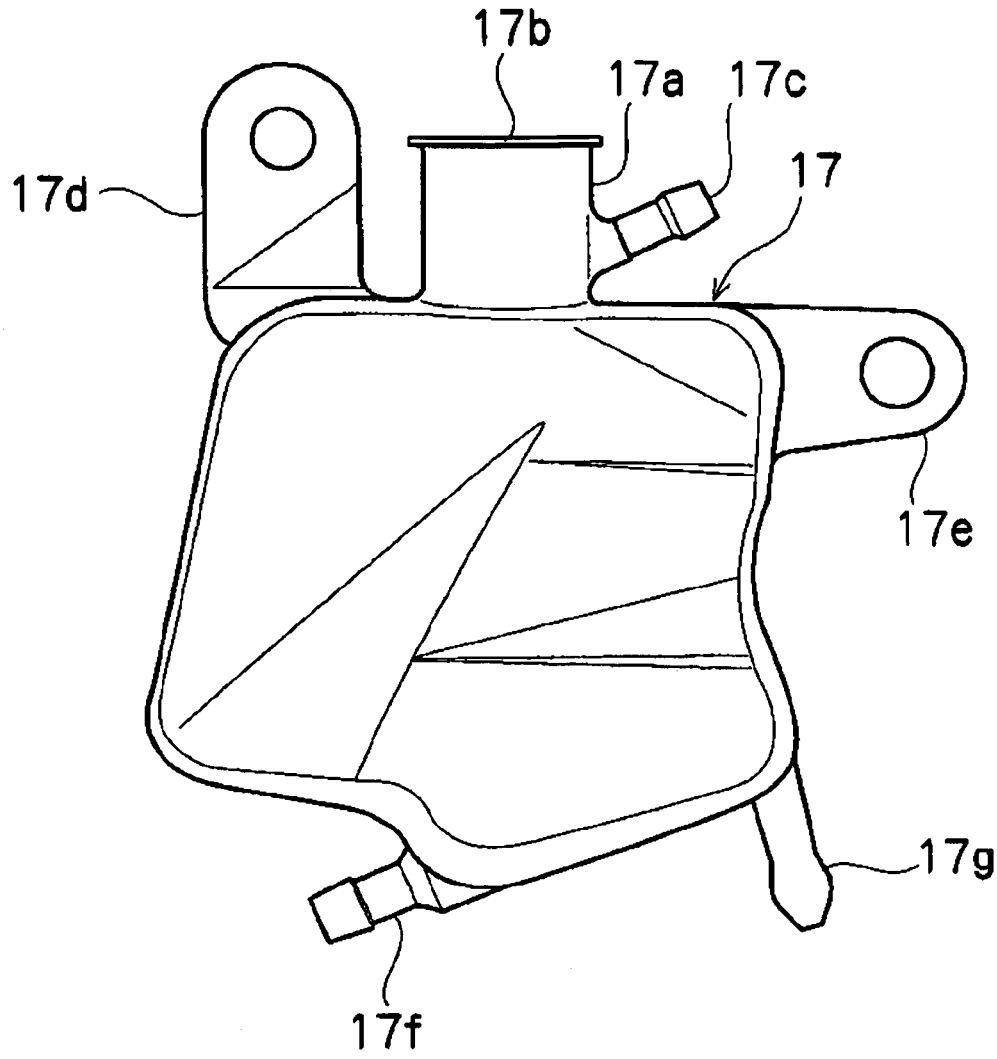
FIG. 5 is a left side view of a reservoir tank used in the motorcycle according to the preferred embodiment shown in FIG. 1.
Figure 6:
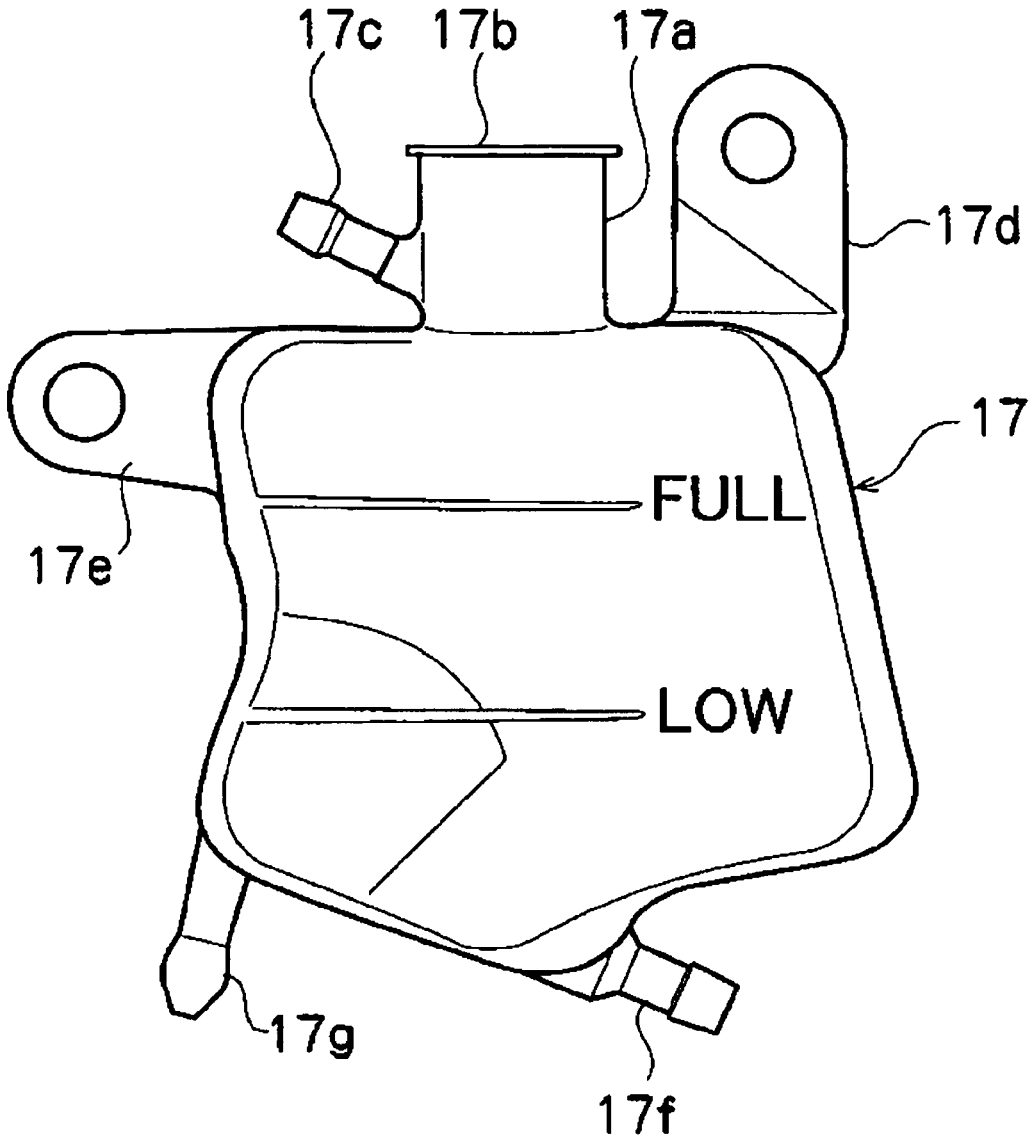
FIG. 6 is a right side view of the reservoir tank used in the motorcycle according to the preferred embodiment shown in FIG. 1.

As shown in FIG. 5 and FIG. 6, the reservoir tank 17 includes, at the upper end, a cylindrical cooling water filler port 17*a*. A cap 17*b* for closing or opening the cooling water filler port 17*a* is attached to the cooling water filler port 17*a*. The cooling water filler port 17*a* is provided, at its side, with a second connection section 17*c*. To the second connection section 17*c* is fastened one end of an atmospheric discharge hose 19. The other end of the atmospheric discharge hose 19 is an opening 19*a* for atmospheric discharge.

A first mounting section 17*d* is arranged at the upper end of the reservoir tank 17 and at the forward section of the cooling water filler port 17*a*. A second mounting section 17*e* is arranged at the rear end of the reservoir tank 17. Further, at the lower end of the reservoir tank 17, and behind the first connection section 17*f*, is arranged a projection 17*g*.

Figure 7:
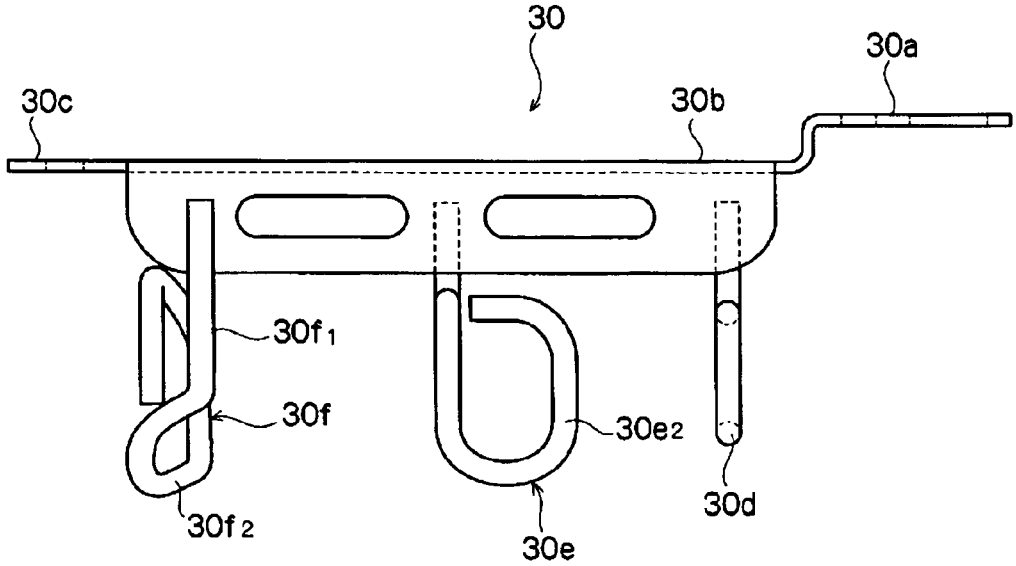
FIG. 7(A) is a plan view of a first bracket for the attachment of the reservoir tank to the vehicle body of the motorcycle according to the preferred embodiment shown in FIG. 1.
FIG. 7(B) is a side view of the first bracket.
Figure 7:
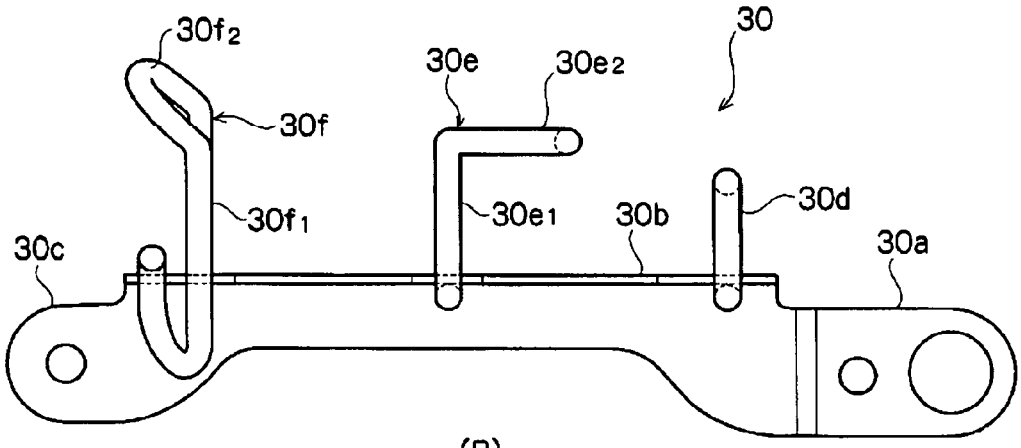

A first bracket 30 is mounted to the first mounting section 17*d* arranged on the reservoir tank 17 (see FIGS. 7(A), 7(B)). With the first bracket 30 mounted to the first mounting section 17*d* and further mounted to the motorcycle 1, the first bracket 30 is arranged such that it is located above the reservoir tank 17. As shown in FIGS. 7(A) and 7(B), the first bracket 30 is provided with a tank side plate-like section 30*a* connected to the first mounting section 17*d* of the reservoir tank 17 with a bolt or other suitable fastening member. One end of a body section 30*b* is connected to the tank side plate-like section 30*a* so as to extend vertically when assembled to the reservoir tank 17. The body section 30*b* includes a first guide section 30*d* for positioning (fixing) the feed and drainage pipe 20. The body section 30*b* includes a second guide section 30*e* located further upward than the first guide section 30*d* when assembled to the vehicle body for positioning (fixing) the feed and drainage pipe 20. Further, the body section 30*b* is provided with a third guide section 30*f* located further upward than the second guide section 30*e* when assembled to the vehicle body for positioning (fixing) the feed and drainage pipe 20. As shown in FIG. 7(B), the second guide section 30*e* is made up of a hollow, perpendicular guide section 30*e*1 extending approximately in the direction perpendicular to the body section 30*b*, and a hollow, parallel guide section 30*e*2 extending approximately in the direction parallel to the body section 30*b*. The third guide section 30*f* is made up of a hollow, guide section body 30*f*1 extending approximately in the direction perpendicular to the body section 30*b*, and a hollow, slanting end section 30*f*2 inclined to the guide section body 30*f*1.

Of the plurality of guide sections 30*d*, 30*e*, and 30*f*, the second guide section 30*e* and the third guide section 30*f* are adapted to position the atmospheric discharge hose 19 as well as the feed and drainage pipe 20. A frame side plate-like section 30*c* is provided at the other end of the body section 30*b*. The frame side plate-like section 30*c* is connected to the mounting section 13*c* of the engine 13 with bolts or the like through a bracket 34 (see FIG. 4) together with a mounting piece 33 (see FIG. 4) arranged at the lower end of the radiator 14.

Figure 8:
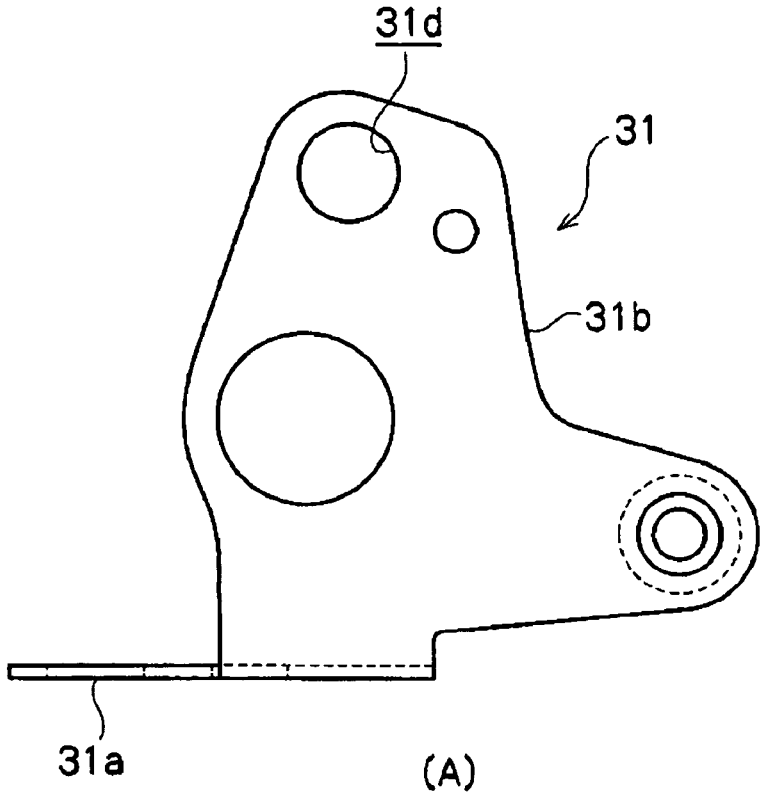
FIG. 8(A) is a plan view of a second bracket for the attachment of the reservoir tank to the vehicle body of the motorcycle according to the preferred embodiment shown in FIG. 1.
FIG. 8(B) is a side view of the second bracket.
Figure 8:
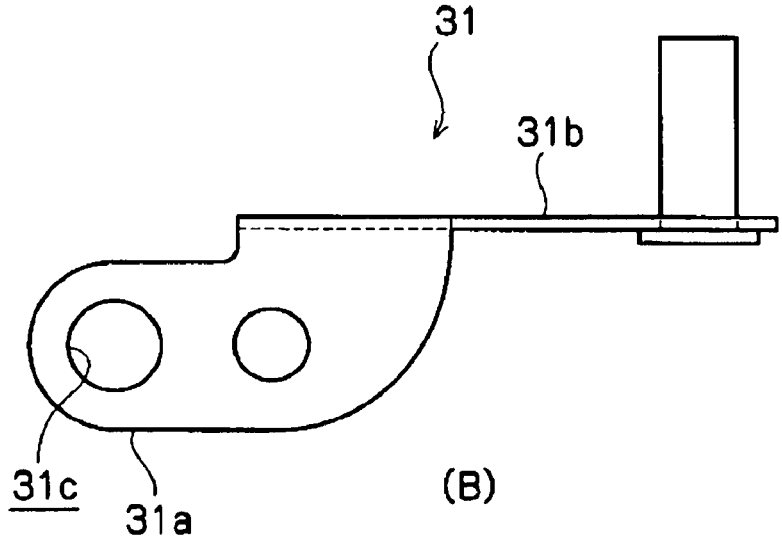

A second bracket 31 (see FIGS. 8(A), 8(B)) is mounted to the second mounting section 17*e* arranged on the reservoir tank 17. As shown in FIG. 8, the second bracket 31 is provided with an insertion support piece 31*a* having an insert hole 31*c* for the projection 17*g* of the reservoir tank 17 to be inserted therein. The insertion support piece 31*a* is integral with a connection support piece 31*b* extending approximately in the direction perpendicular to the insertion support piece 31*a* and connected to the second mounting section 17*e* of the reservoir tank 17 with a bolt or the like. The connection support piece 31*b* includes a mounting hole 31*d* for a bolt or other suitable fastening member to be inserted therein during assembly to the mounting section 13*d* of the engine 13.

Figure 3:
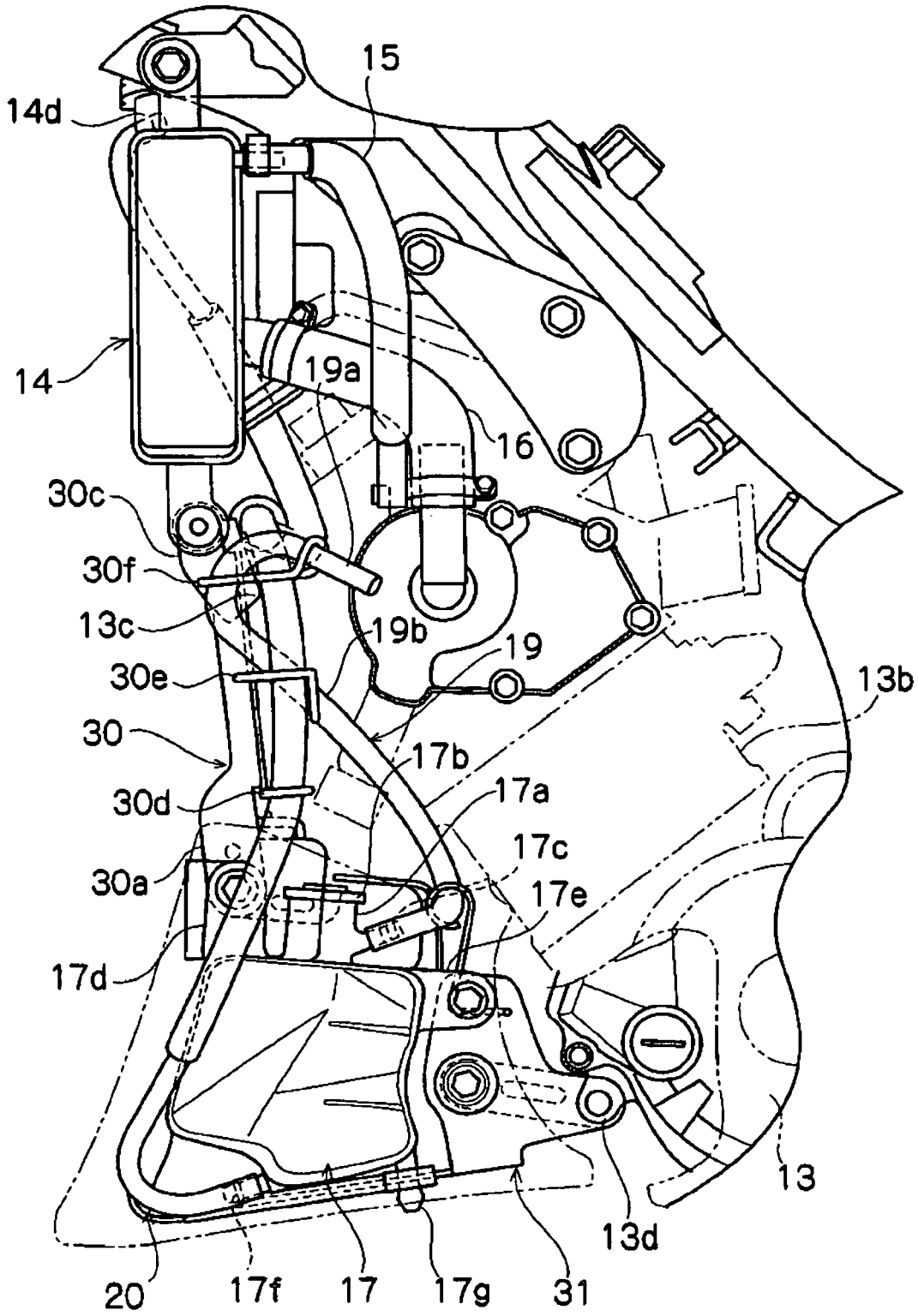
FIG. 3 is a side view of a portion around an engine of the motorcycle according to the preferred embodiment shown in FIG. 1.
Figure 4:
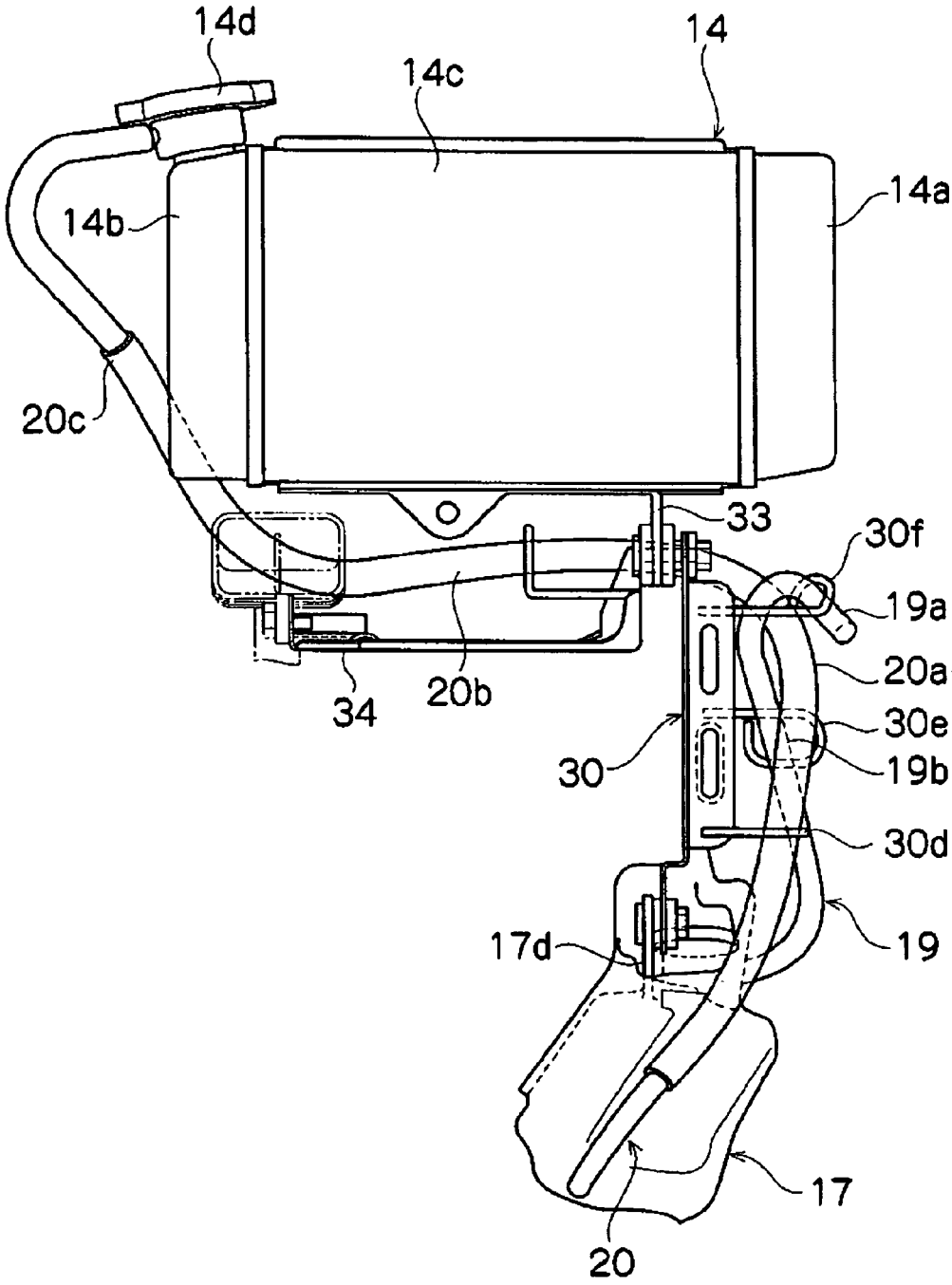
FIG. 4 is a front view of a portion around a radiator of the motorcycle according to the preferred embodiment shown in FIG. 1.

As shown in FIG. 3 and FIG. 4, the feed and drainage pipe 20 is connected to the first connection section 17*f* of the reservoir tank 17, and the feed and drainage pipe 20 passes in front of the reservoir tank 17 to be inserted into the first guide section 30*d*, second guide section 30*e* and third guide section 30*f* of the first bracket 30. As a result of the feed and drainage pipe 20 being inserted in the first guide section 30*d*, second guide section 30*e* and third guide section 30*f*, the feed and drainage pipe 20 is positioned. Also, the feed and drainage pipe 20, after being inserted in the third guide section 30*f*, passes under the radiator 14, goes to the left with respect to the body center line when viewed from the front of the vehicle body, and is connected to the cap section 14*d* of the radiator 14. In this manner, the feed and drainage pipe 20 is made up of a first vertical section 20*a* located in the vicinity of the reservoir tank 17 which is inserted into the guide sections 30*d*, 30*e*, and 30*f* and extending approximately vertically, a horizontal section 20*b* extending below the radiator 14 approximately horizontally, and a second vertical section 20*c* extending approximately vertically on the left side of the radiator 14 when viewed from the front of the vehicle body.

The atmospheric discharge hose 19 is connected to the second connection section 17*c* of the reservoir tank 17 and, after being inserted in the parallel guide section 30*e*2 of the second guide section 30*e*, is inserted into the perpendicular guide section 30*e*1. The atmospheric discharge hose 19, after being inserted in the perpendicular guide section 30*e*1 of the second guide section 30*e*, is inserted into the guide section body 30*f*1 of the third guide section 30*f* and further into the slanting end section 30*f*2. In this manner, the atmospheric discharge hose 19 is positioned by the guide sections 30*e*, 30*f*. In particular, the opening 19*a* of the atmospheric discharge hose 19 is positioned by the slanting end section 30*f*2 in the state of opening rearward and downward of the vehicle body.

The opening 19*a* of the atmospheric discharge hose 19 and the feed and drainage pipe 20 are positioned (fixed) by common fixing members such as the second guide section 30*e* and the third guide section 30*f*. Therefore, the opening 19*a* of the atmospheric discharge hose 19, and its halfway region 19*b* extending to the opening 19*a*, are located in the vicinity of the feed and drainage pipe 20. In other words, the lower portion of the first vertical section 20*a* of the feed and drainage pipe 20 is at a position in the vicinity of the reservoir tank 17, and the opening 19*a* of the atmospheric discharge hose 19 is located in the vicinity of the upper portion of the first vertical section 20*a*. Also, the opening 19*a* of the atmospheric discharge hose 19 is located in the vicinity of an upper portion of the first bracket 30.

In the present preferred embodiment as described above, since the reservoir tank 17 is located further downward than the radiator 14, the atmospheric discharge hose 19 is arranged such that its opening 19*a* is located above the reservoir tank 17 and below the radiator 14.

As shown in FIG. 1, the motorcycle 1 is provided with an exhaust pipe 21 having one end connected to the cylinder 13*b* of the engine 13, the exhaust pipe 21 being bent toward the left when viewed from the front of the vehicle body and extending rearwardly. The exhaust pipe 21 is disposed on the right side with respect to the body center line, when viewed from the front of the vehicle body, which is the opposite side from the reservoir tank 17. A muffler 22 is connected to the other end of the exhaust pipe 21.

The rear arm bracket 4 connected to the main frame 3 is provided with a pivot shaft 23. The rear arm 24 is pivoted at its forward end by the pivot shaft 23 for up and down swinging movement. A rear wheel 25 is mounted to the rear end of the rear arm 24 for rotation. A seat 26 is disposed above the seat rail 5. Also, a body cover 27 is attached to the vehicle body from the forward portion to the rear portion thereof so as to cover the head pipe 2 and the seat rail 5. A rear fender 28 covering the rear wheel 25 thereabove is mounted behind the body cover 27 in the running direction (in the direction of arrow FWD in FIG. 1).

A pair of leg shields 29, for covering the front of the driver's legs, is provided forward of the body cover 27 and spaced at a given distance in the lateral direction of the vehicle body (in the direction of arrow A in FIG. 2). The pair of leg shields 29 is disposed on both sides of the radiator 14 and reservoir tank 17 such that they hold the radiator 14 and reservoir tank 17 therebetween from both sides. That is, the radiator 14 and reservoir tank 17 are disposed inside the leg shields 29 such that they are covered by the leg shields 29 when viewed in the lateral direction.

As described above, since in the present preferred embodiment, the opening 19*a* of the atmospheric discharge hose 19 is located in the vicinity of the feed and drainage pipe 20, the atmospheric discharge hose 19 and feed and drainage pipe 20 can be fixed to the vehicle body with a single third guide section 30*f*. As a result, fixing of the atmospheric discharge hose 19 and feed and drainage pipe 20 to the vehicle body can be simplified. The expression "to the vehicle body" in the present preferred embodiment includes the engine and the body frame.

In addition, since in the present preferred embodiment, the opening 19*a* of the atmospheric discharge hose 19, or its portion in the vicinity of the opening 19*a*, is fixed to the vehicle body with the third guide section 30*f* common to the feed and drainage pipe 20, both of them can be fixed to the vehicle body with a single third guide section 30*f*.

Further, since in the present preferred embodiment, a halfway region 19*b* of the atmospheric discharge hose 19 is located in the vicinity of the feed and drainage pipe 20, the halfway region 19*b* of the atmospheric discharge hose 19 can be fixed to the vehicle body with the second guide section 30*e*. At the same time, the feed and drainage pipe 20 can be positioned by the second guide section 30*e* such that it is prevented from being located in the vicinity of the cylinder 13*b* of the engine 13.

Further, since in the present preferred embodiment, the opening 19*a* of the atmospheric discharge hose 19 is located above the reservoir tank 17, the atmospheric discharge hose 19 can be disposed at a higher position than the reservoir tank 17. Therefore, the reservoir tank 17 can be disposed within a dead space below and in front of the engine 13, and water intrusion into the opening 19*a* of the atmospheric discharge hose 19 can be prevented even when the motorcycle 1 passes through a puddle.

Further, since in the present preferred embodiment, the opening 19*a* of the atmospheric discharge hose 19 is located below the radiator 14, positioning of the opening 19*a* of the atmospheric discharge hose 19 becomes easier compared with an arrangement in which the opening 19*a* of the atmospheric discharge hose 19 is located above the radiator 14. As a result, the length of the atmospheric discharge hose 19 is no longer than necessary, thereby reducing weight and manufacturing costs.

Further, in the present preferred embodiment, the lower portion of the first vertical section 20*a* of the feed and drainage pipe 20 extending approximately vertically is at a position in the vicinity of the reservoir tank 17, and the opening 19*a* of the atmospheric discharge hose 19 is located in the vicinity of the upper portion of the first vertical section 20*a* of the feed and drainage pipe 20 extending approximately vertically. Therefore, the length of the atmospheric discharge hose 19 can be decreased to an essential minimum, with the opening 19*a* of the atmospheric discharge hose 19 disposed at a higher position.

Furthermore, since in the present preferred embodiment, the opening 19*a* of the atmospheric discharge hose 19 opens rearwardly, intrusion of rain water or muddy water splashed up by the front wheel 8 of the motorcycle 1 into the opening 19*a* of the atmospheric discharge hose 19 can be prevented during running of the motorcycle 1. In particular, as a result of the opening 19*a* of the atmospheric discharge hose 19 opening rearwardly, intrusion of rain water or muddy water can be prevented, with the length of the atmospheric discharge hose 19 reduced to an essential minimum.

Further, since in the present preferred embodiment, the opening 19*a* of the atmospheric discharge hose 19 opens downwardly, intrusion of rain water into the opening 19*a* of the atmospheric discharge hose 19 can be prevented during running of the motorcycle 1 or at the time the motorcycle 1 is stopped.

Further, since in the present preferred embodiment, the reservoir tank 17 can be mounted to the vehicle body through the first bracket 30 and second bracket 31, the so-called unitization is possible and the reservoir tank 17 can be mounted to the vehicle body easily. At this time, since the feed and drainage pipe 20 and the atmospheric discharge hose 19 have been positioned by the guide sections 30*d*, 30*e*, and 30*f* of the first bracket 30, the feed and drainage pipe 20 and the atmospheric discharge hose 19 need not be positioned after the reservoir tank 17 has been mounted to the vehicle body. As described above, since installation of the reservoir tank 17 and positioning of the feed and drainage pipe 20 and the atmospheric discharge hose 19 are completed at the same time, assembly work of the reservoir tank 17 to the vehicle body can be simplified to a large extent.

Further, a special positioning member for positioning the atmospheric discharge hose 19 is dispensed with, thereby reducing the number of parts. Although each of the first bracket 30 and second bracket 31 may be arranged separate from the reservoir tank 17, the number of parts can be reduced further improving assembling properties to the vehicle body if the first bracket 30 and second bracket 31 are integral with the reservoir tank 17.

Further, since in the present preferred embodiment, the mounting member for the installation of the reservoir tank 17 to the vehicle body is made up of a plurality of constituent members such as the first bracket 30 and second bracket 31, shapes of the first bracket 30 and second bracket 31 can be simplified even when the shape as a mounting member becomes complicated. As a result, the structure of forming dies used for manufacturing the first bracket 30 and second bracket 31 can be simplified, facilitating installation of the first bracket 30 and second bracket 31 and thus the mounting members for the installation of the reservoir tank 17 to the vehicle body.

Further, since in the present preferred embodiment, the first bracket 30 and second bracket 31 are attached together through the reservoir tank 17, the first bracket 30 and second bracket 31 can be made smaller compared with when the first bracket 30 and second bracket 31 are attached directly.

Further, since in the present preferred embodiment, the first bracket 30 is located above the reservoir tank 17, the reservoir tank 17 can be disposed in a lower region within a dead space. Also, if the reservoir tank 17 is disposed in a lower region, the atmospheric discharge hose 19 can be located at a position higher than the reservoir tank 17. As a result, intrusion of muddy water into the opening 19*a* of the atmospheric discharge hose 19 can be prevented even if the motorcycle 1 runs through a puddle or the like.

Further, since in the present preferred embodiment, the opening 19*a* of the atmospheric discharge hose 19 is located in the vicinity of the upper portion of the first bracket 30, the opening 19*a* of the atmospheric discharge hose 19 is disposed at a relatively high position. As a result, intrusion of muddy water into the opening 19*a* of the atmospheric discharge hose 19 can be prevented even if the motorcycle 1 runs through a puddle or the like.

Further, the disclosed present preferred embodiment is to be taken as an example in all respects and it is to be understood that this invention is not limited to the present preferred embodiment. The scope of this invention is defined by the appended claims rather than by the description of the foregoing preferred embodiment, including all changes that fall within the metes and bounds of the claims or equivalents of such metes and bounds.

For example, although in the foregoing preferred embodiment an example is shown of an under-bone type motorcycle 1 having a low main frame, the present invention is not limited to that. The invention may be applied to other vehicles in addition to the motorcycle 1, such as three wheelers and ATVs (All Terrain Vehicles) if they are of an under-bone type provided with a heat exchanger for cooling the engine 13.

Further, although in the foregoing preferred embodiment an example is shown in which the first bracket 30 and second bracket 31 are independent members separate from the reservoir tank 17, the present invention is not limited to that. For example, the first bracket 30 and second bracket 31 may be integral with the reservoir tank 17. This allows a significant reduction in the number of parts as well as in assembly manhours.

Further, although in the foregoing preferred embodiment an example is shown in which the first bracket 30 is integral with the first guide section 30*d*, second guide section 30*e*, and third guide section 30*f*, the present invention is not limited to that. For example, at least one of the first guide section 30*d*, second guide section 30*e*, and third guide section 30*f* may be an independent member separately attached to the first bracket 30.

Further, although in the foregoing preferred embodiment an example is shown in which the reservoir tank 17 is mounted to the vehicle body with the first bracket 30 and second bracket 31, the present invention is not limited to that. For example, the reservoir tank 17 may be mounted to the vehicle body with a single bracket (not shown), or with three or more brackets (not shown).

Although in the foregoing preferred embodiment an example is shown in which the first bracket 30 and second bracket 31 are assembled through the reservoir tank 17, the present invention is not limited to that. For example, each of the first bracket 30 and second bracket 31 may be made larger and assembled directly to each other, and the reservoir tank 17 is mounted to the vehicle body with these assembled brackets.

Figure 9:
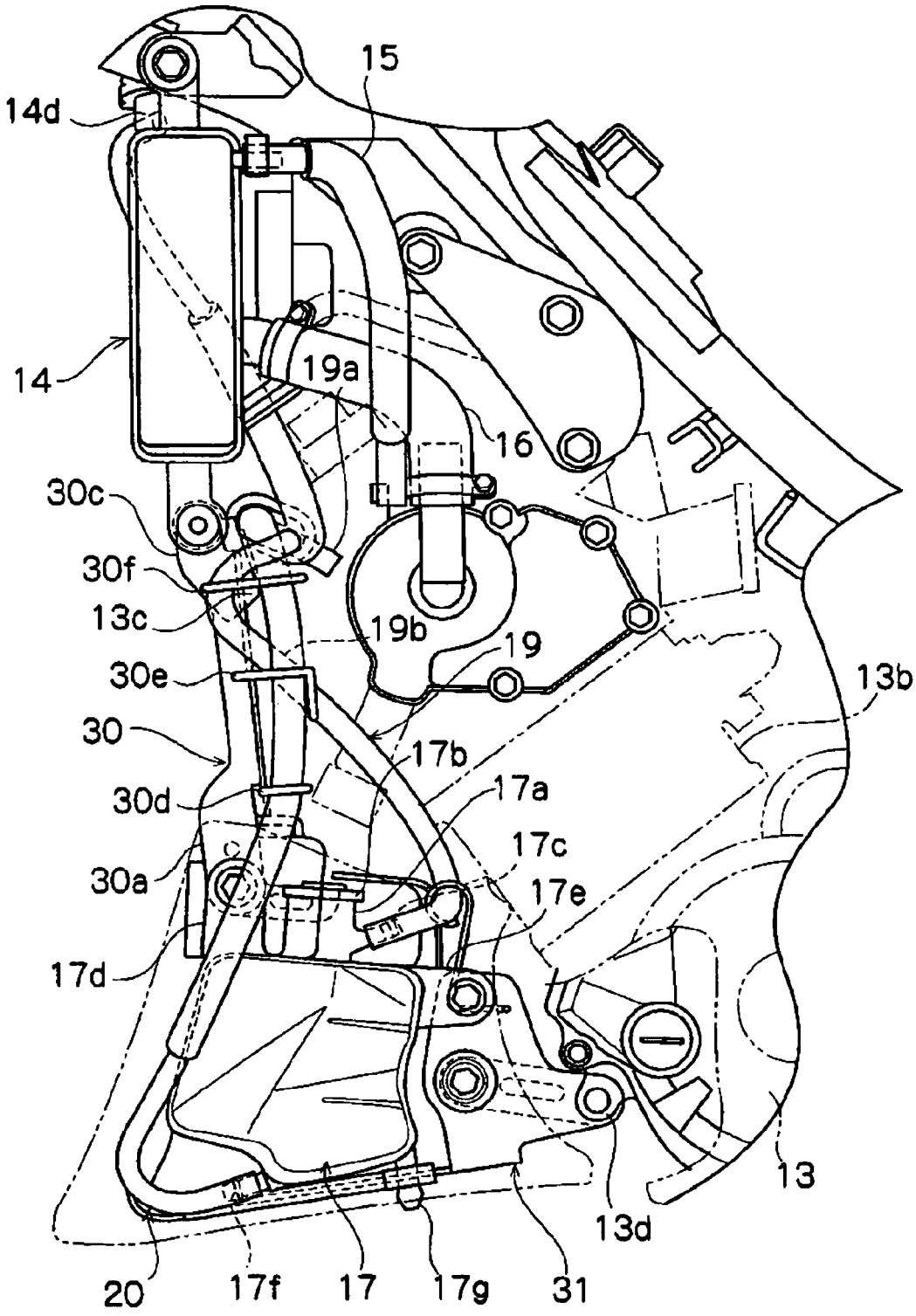
FIG. 9 is a side view showing a variation of the portion around the engine of the motorcycle according to the preferred embodiment shown in FIG. 3.
Figure 10:
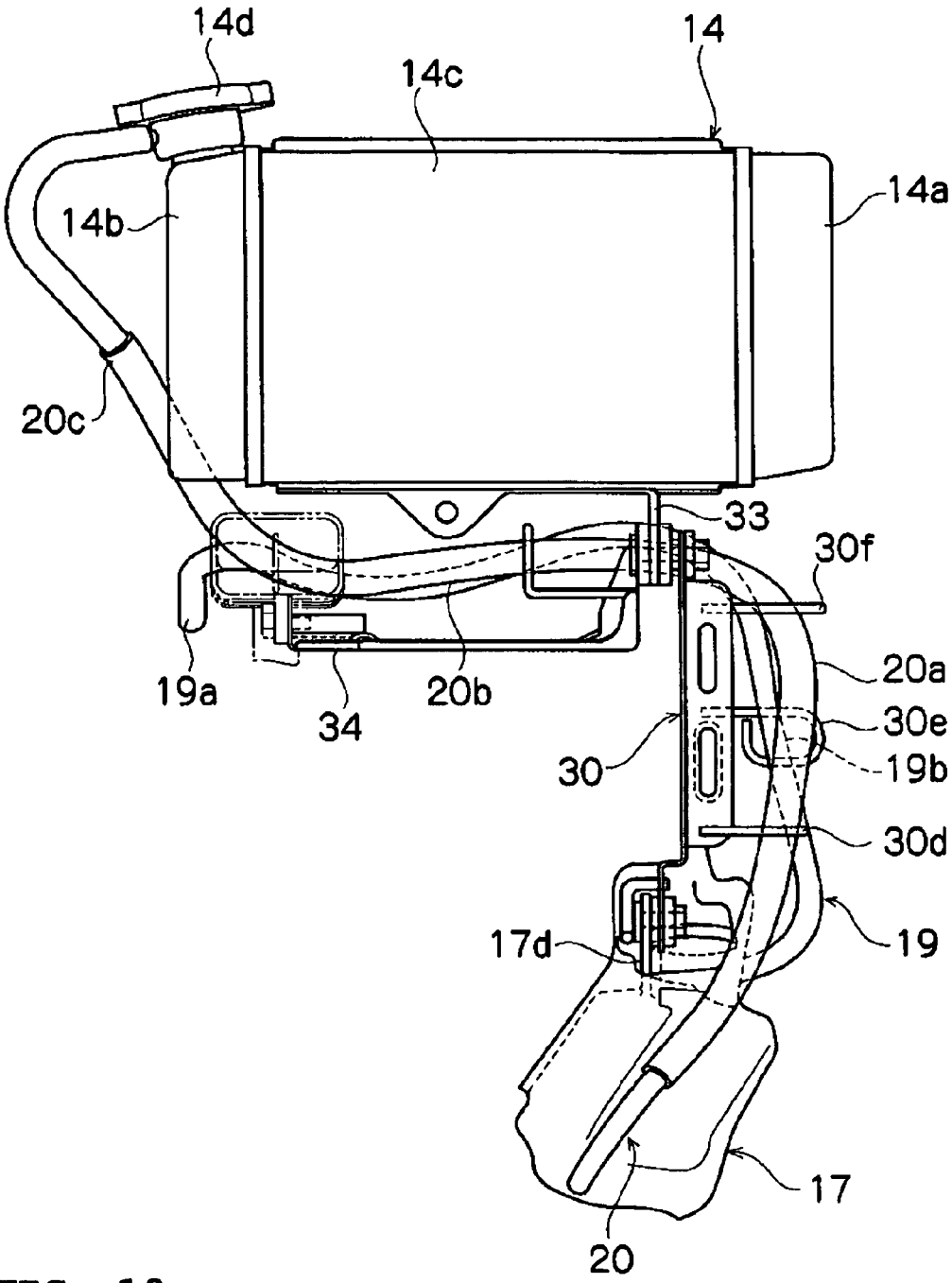
FIG. 10 is a front view showing a variation of the portion around the radiator of the motorcycle according to the preferred embodiment shown in FIG. 4.

Further, although in the foregoing preferred embodiment an example is shown in which the opening 19*a* of the atmospheric discharge hose 19 is positioned by the slanting end section 30*f*2 of the third guide section 30*f*, the present invention is not limited to that. For example, as shown in FIG. 9 and FIG. 10, the atmospheric discharge hose 19 may be elongated so as to extend horizontally together with the horizontal section 20*b* of the feed and drainage pipe 20, so that the opening 19*a* is located on the left side of the radiator 14 with respect to the body center line when viewed from the front of the vehicle body. In this case, as in the foregoing preferred embodiment, the opening 19*a* of the atmospheric discharge hose 19 is in the state of opening rearward and downward of the vehicle body.

While the present invention has been described with respect to preferred embodiments, it will be apparent to those skilled in the art that the disclosed invention may be modified in numerous ways and may assume many embodiments other those specifically set out and described above. Accordingly, it is intended by the appended claims to cover all modifications of the present invention which fall within the true spirit and scope of the present invention.

What is claimed is:

1. A vehicle comprising:

a heat exchanger arranged to cool an engine;

a reservoir tank arranged to store liquid therein;

a connection member connecting the heat exchanger and the reservoir tank;

an atmospheric discharge member attached to the reservoir tank and having an atmospheric discharge opening located in the vicinity of the connection member; and a fixing member; wherein the opening of the atmospheric discharge member and the connection member are fixed to the vehicle by the fixing member; and the opening of the atmospheric discharge member is located above an upper surface of the reservoir tank and below a bottom surface of the heat exchanger.

2. The vehicle as set forth in claim 1, wherein the fixing member includes a first guide, a second guide, and a third guide, the first guide of the fixing member fixing the connection member to the vehicle.

3. The vehicle as set forth in claim 2, wherein the second guide and the third guide fix both the connection member and the atmospheric discharge member to the vehicle.

4. The vehicle as set forth in claim 1, wherein a middle region of the atmospheric discharge member is located in the vicinity of the connection member.

5. The vehicle as set forth in claim 1, wherein the opening of the atmospheric discharge member opens rearwardly with respect to the vehicle.

6. A vehicle comprising:

a heat exchanger arranged to cool an engine;

a reservoir tank arranged to store liquid therein;

a connection member connecting the heat exchanger and the reservoir tank; and an atmospheric discharge member attached to the reservoir tank and having an atmospheric discharge opening located in the vicinity of the connection member; wherein the reservoir tank is located below a bottom surface of the heat exchanger, and the opening of the atmospheric discharge member is located above an upper surface of the reservoir tank and below the bottom surface of the heat exchanger.

7. A vehicle comprising:

a heat exchanger arranged to cool an engine;

a reservoir tank arranged to store liquid therein;

a connection member connecting the heat exchanger and the reservoir tank; and an atmospheric discharge member attached to the reservoir tank and having an atmospheric discharge opening located in the vicinity of the connection member; wherein the connection member has, in a middle portion thereof, a vertical region extending approximately in a vertical direction, a lower portion of the vertical region is arranged at a position in the vicinity of the reservoir tank, and the opening of the atmospheric discharge member is located in the vicinity of an upper portion of the vertical region; and the opening of the atmospheric discharge member is located above an upper surface of the reservoir tank and below a bottom surface of the heat exchanger.

8. A vehicle comprising:

a heat exchanger arranged to cool an engine;

a reservoir tank arranged to store liquid therein;

a connection member connecting the heat exchanger and the reservoir tank; and an atmospheric discharge member attached to the reservoir tank and having an atmospheric discharge opening located in the vicinity of the connection member; wherein the opening of the atmospheric discharge member opens downwardly with respect to the vehicle; and the opening of the atmospheric discharge member is located above an upper surface of the reservoir tank and below a bottom surface of the heat exchanger.

9. A vehicle comprising:

a heat exchanger arranged to cool an engine;

a reservoir tank arranged to store liquid therein;

an atmospheric discharge member attached to the reservoir tank and provided with an atmospheric discharge opening; and a mounting member arranged to attach the reservoir tank to a vehicle body and to position the atmospheric discharge member; wherein the mounting member is located above the reservoir tank; and the opening of the atmospheric discharge member is located above an upper surface of the reservoir tank and below a bottom surface of the heat exchanger.

10. The vehicle as set forth in claim 9, wherein the mounting member is separate from the reservoir tank, and the mounting member includes a plurality of constituent members.

11. The vehicle as set forth in claim 10, wherein the constituent members are attached to the reservoir tank.

12. The vehicle as set forth in claim 9, wherein the mounting member is integral with the reservoir tank.

13. A vehicle comprising:

a heat exchanger arranged to cool an engine;

a reservoir tank arranged to store liquid therein;

an atmospheric discharge member attached to the reservoir tank and provided with an atmospheric discharge opening; and a mounting member arranged to attach the reservoir tank to a vehicle body and to position the atmospheric discharge member; wherein the opening of the atmospheric discharge member is located in the vicinity of an upper portion of the mounting member; and the opening of the atmospheric discharge member is located above an upper surface of the reservoir tank and below a bottom surface of the heat exchanger.

* * * * *